US007111560B1

(12) United States Patent
Frost

(10) Patent No.: US 7,111,560 B1
(45) Date of Patent: Sep. 26, 2006

(54) MODEL RAILROAD RERAILER

(75) Inventor: Donald J. Frost, 15402 N. 60th St., Scottsdale, AZ (US) 85254

(73) Assignee: Donald J. Frost, Scottsdale, AZ (US)

( * ) Notice: Subject to any disclaimer, the term of this patent is extended or adjusted under 35 U.S.C. 154(b) by 0 days.

(21) Appl. No.: 10/908,432

(22) Filed: May 11, 2005

(51) Int. Cl.
*B61K 13/00* (2006.01)

(52) U.S. Cl. ..... 104/265; 104/269; 104/DIG. 1; 238/10 R

(58) Field of Classification Search ..... 104/262, 104/264, 265, 267, 268, 269, 270; 238/10 R, 238/10 A, 10 B, 10 C, 10 E, 10 F See application file for complete search history.

(56) References Cited

U.S. PATENT DOCUMENTS 1,888,760 A * 11/1932 Butler ..... 104/264
2,354,473 A * 7/1944 Neubaum et al. ..... 104/267

* cited by examiner

*Primary Examiner*—Mark T. Le
(74) *Attorney, Agent, or Firm*—Snell & Wilmer LLP

(57) ABSTRACT

A new and novel self-locating railcar rerailing device of one-piece construction is provided. A track insert is configured to be installed within a track gauge of either straight or curved sections of an existing model railroad track layout. The sloped and shaped ends of the preferred embodiment and up-ramps of an alternative embodiment each engage the derailed wheels of a moving railcar in such a manner that, with either forward or backward motion, the railcar wheels are guided back into both vertical and horizontal alignment with the tracks.

7 Claims, 4 Drawing Sheets

MODEL RAILROAD RERAILER

FIELD OF INVENTION

The present invention relates generally to a unique rerailing device, and more particularly, to a rerailing device that may be retrofitted to existing model railroad track layouts without disrupting any of the prelaid tracks which is useful in rerailing derailed model railroad cars and/or engines.

BACKGROUND OF INVENTION

For many generations, model railroading has been a popular and fascinating hobby for modelers of all ages. Throughout the years the technical aspects of the hobby have grown in all areas of expertise. From the somewhat crude wind-up toy engines of a century ago to the highly sophisticated electronically powered engines of today, hobbyists now have the opportunity to select the size and type of model railroad they wish to build and command. The currently available sizes range from the smallest at 1:220 of actual size, which can be built on a tabletop, to the largest at 1:22.5 of actual size which is commonly used out-of-doors in a garden like environment. The more popular sizes selected by most of today's hobbyists are the "N" gage at 1:160, and the "HO" gage at 1:870 real life size.

Traditionally, those hobbyists who are involved particularly in either "N" or "HO" gage modeling will selectively use flexible model railroad track, which is available in a variety of lengths up to approximately 36 inches, rather than using sections of shorter tracks of specific length, since the longer sections have the ability to be formed, shaped and/or curved to suit the design of the track layout while also requiring fewer joints that must be connected in order to make a continuous run. Flexible track, with its greater utility, is customarily laid down over a cork roadbed and then secured into place, such as by nailing or tacking, to an underlying rigid substrate, such as plywood. This creates a rather permanent track layout. During the installation of track, it is often necessary to install one or more devices, which can rerail cars that may become derailed during operation. One such device commonly used is constructed of rigid plastic molded about a short section of electrically conductive track. Often, this device will be strategically located in close proximity to the operators location near the control panel to aid in the initial placement of engines and/or cars to the tracks prior to operation. Other rerailers, often of the same or similar design, may be used where it is anticipated that derailments might occur along the track right-of-way.

In practice, however, identifying where a derailment might occur is not always immediately apparent. That is, while certain areas may be identified as likely derailment locations, due to the particular layout of the modeler's choosing, other areas where derailments occur may only become observable through use. In this instance, to remedy the situation, it may become necessary to add rerailers at these troublesome locations. To do so, however, often necessitates disrupting certain sections of track, by requiring cutting, removing and relaying of the tracks in order to accommodate the installation of each new rerailer. This is a tedious and often difficult task once a track layout has been finalized and many other track accessories are in place.

Accordingly, there exists a long felt and heretofore unresolved need for a rerailer that addresses these disadvantages.

SUMMARY OF INVENTION

To overcome the limitations in the prior art described above, and to overcome other limitations that will become apparent upon reading and understanding the present specification, hereinafter referred to as a "rerailer", the present invention is an apparatus for rerailing derailed model railroad cars.

According to an advantageous embodiment of the present invention, a device for rerailing a derailed model railroad car is provided which is suitably self-locating upon installation at a desired location within existing model railroad track layouts.

While the way in which such a device can be configured and may be used to address the foregoing disadvantages will be described in greater detail hereinbelow, in general, when inserted within a track gauge, the device is suitably configured to engage a derailed wheel of a moving railcar and/or engine and guide it back onto a track by lifting the wheel vertically while aligning it with the top of the track.

In accordance with another preferred embodiment of the present invention, the rerailer may be configured in the shape of an elongated polygon wherein opposing wedge shaped ends include a leading end incline. As will become more apparent by the disclosure and figures herein, this shape provides for vertical alignment by the leading end incline, as well as the horizontal alignment by the widening of the wedge shaped end, and is therefore capable of rerailing cars traveling either forward or backward.

BRIEF DESCRIPTION OF THE DRAWINGS

The above objects and advantages of the present invention will become more apparent by describing in detail preferred embodiments thereof with reference to the attached drawings in which.

DETAILED DESCRIPTION

Figure 1:
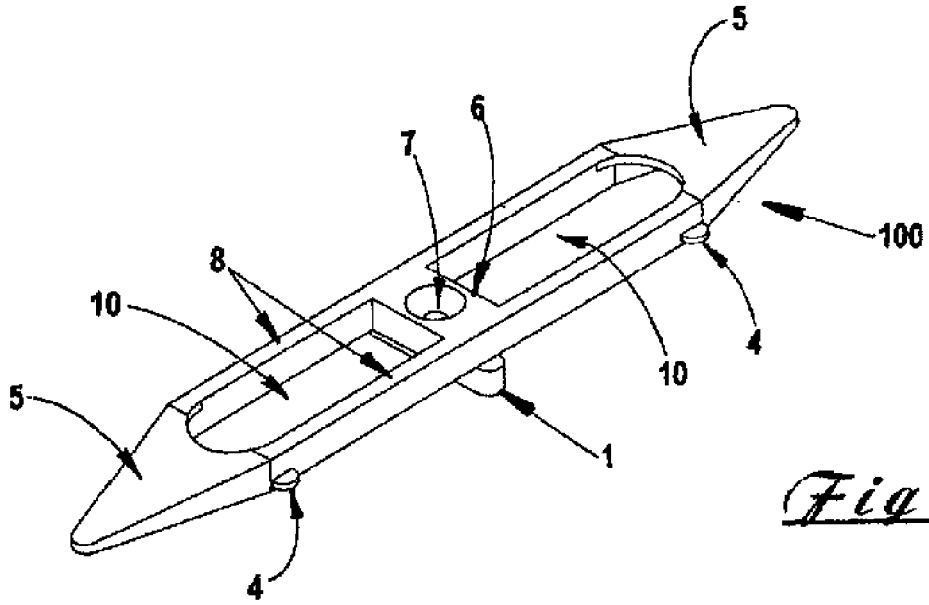
FIG. 1 is a top perspective view of an exemplary rerailer in accordance with one embodiment of the present invention.

In the following description of the exemplary embodiment, reference is made to the accompanying drawings, which form a part hereof, and in which is shown by way of illustration the specific embodiment in which the invention may be practiced. It is to be understood that other embodiments may be utilized as structural and/or design changes may be made without departing from the scope of the present invention.

A railcar, as used herein, may include any removable unit suitably configured to be placed in and along a track. A railcar may include, for example, a toy train engine or toy train car. Practitioners however, will appreciate that the present invention may also be employed in any number of other applications, which incorporate wheels and a track and is not solely limited to a model railroad implementation.

With reference to the appended drawings, FIGS. 1–8, it should be noted that these drawings are exemplary in nature wherein like reference numerals designate like parts as referred to in the following preferred embodiments, and which in no way serve to limit the scope of the invention.

FIG. 1 is a top perspective view of an exemplary rerailer. In a preferred embodiment, a rerailer 100 preferably comprises a single unit insert 100 which may be comprised of any material, but preferably is molded of a semi-flexible material such as polypropylene, for example. Respective openings 10 in rerailer 100 may add to the flexibility feature, providing sufficient flexibility to enable it to be installed in both straight and curved track sections.

Figure 2:
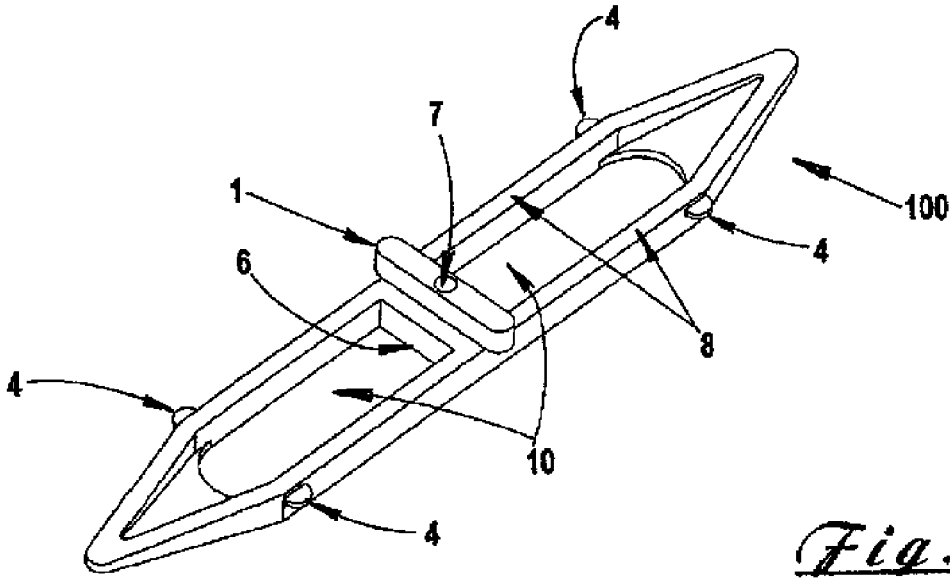
FIG. 2 is a bottom perspective view showing further details of an exemplary rerailer of FIG. 1.

With continued reference to FIGS. 1 and 2, a centrally located strut 6 may serve to keep the center section narrow side portions 8 in proper alignment with track rails when installed. Further, strut 6 may provide support of cleat 1 which will be discussed in reference to FIG. 3 hereinbelow. Strut 6 may include a vertical bore 7 through which a fastener, for example, such as a nail or screw and/or the like, may be inserted to secure rerailer 100 to a track section. Bore 7 may further include a countersink to enable a fastener head to remain flush with the top surface of strut 6.

Respective ends 5 of rerailer 100 may further include inclined sections. It should be appreciated that both ends of the device may be identical, therefore "leading end" as used herein, is relative to the directional motion of the railcar and/or engine. Both end sections 5 may include a vertical slope beginning at the height flush with the top side of the center section and ending with a height that is nearly flush with the bottom side of the center section. Each end section 5 may further include a distally tapered feature wherein the taper begins at a width equal to the center section and ends with any lesser width including a point. Practitioners will appreciate that slope and taper dimensions may vary according to implementation such as, for example, the gauge of track to which rerailer 100 is to be implemented.

Figure 3:
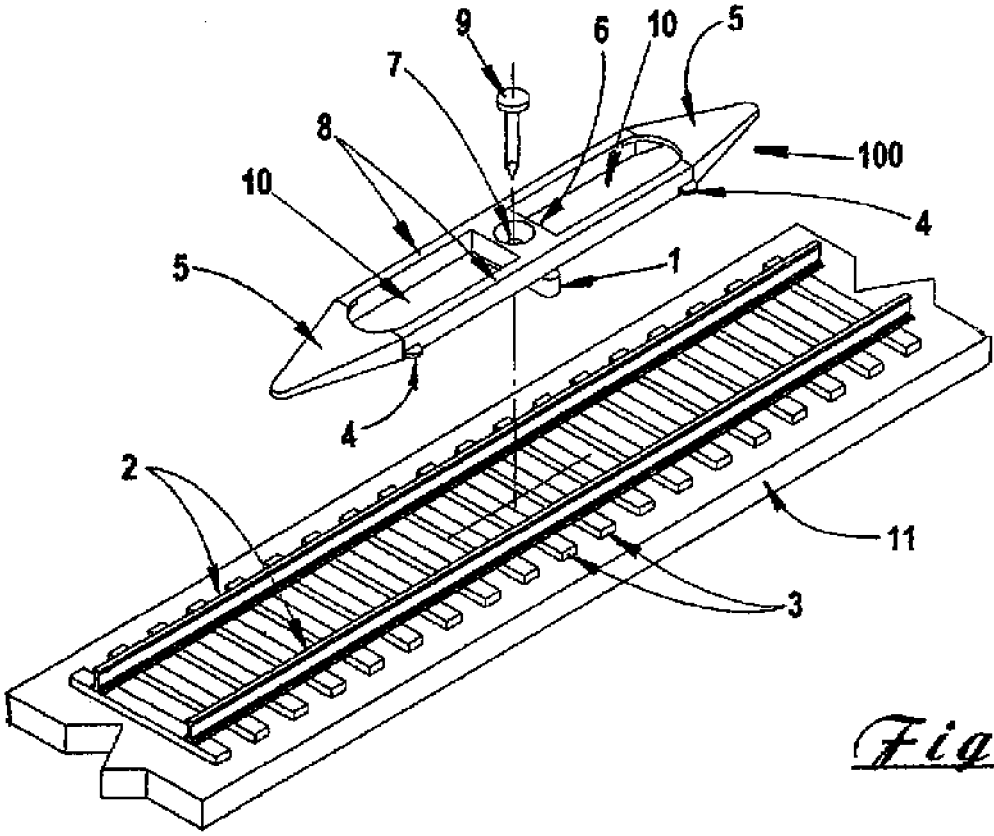
FIG. 3 is an exploded perspective view of an exemplary rerailer further showing its placement relative to a fragmentary track section prior to installation.

With reference now to FIGS. 2 and 3, in accordance with one preferred embodiment of the present invention, rerailer 100 may include a cleat 1. Cleat 1 preferably is located central of rerailer 100 and extends axially beyond the side portions of the rerailer 100 center section. Further, cleat 1 may have a width to enable it to be suitably received between two ties 3 within a track section. In accordance with one aspect of this embodiment cleat may be configured in any shape that permits engagement of the inner portion of track rails 2 when installed to facilitate more precise centering within a track gauge. Stated another way, cleat 1 is a mechanism which facilitates rerailer 100 to be self-locating and/or provide additional stability to rerailer 100.

While cleat 1 may ensure proper centering of rerailer 100 within a track gauge, spacers 4 may be provided to further prevent rerailer 100 from pivoting when engaged by moving cars. For example, in accordance with one embodiment, spacers 4, each having a length sufficient to engage the inner portion of track rails 2, may be preferably positioned proximate to each of the four corners of the center section of rerailer 100. While the number and placement of spacers 4 are illustrated and described herein, practitioners will appreciate that any number and configuration of spacers may be employed without departing from the scope of the invention.

To secure rerailer 100 within a track gauge, a fastener 9 may be inserted through vertical bore 7 and into track substrate 11. Fastener 9, may comprise a nail, flat headed screw or any other fastening means known in the art. Substrate 11, may comprise cork, plywood, rubber or any other material known in the art for providing a suitable base for a track layout. While the preferred embodiment may include a fastener 9 to secure rerailer 100 within a track gauge, practitioners will appreciate that a fastener 9 may not be necessary. For example, modeling glue or other fixation mechanisms may likewise be used.

Figure 4:
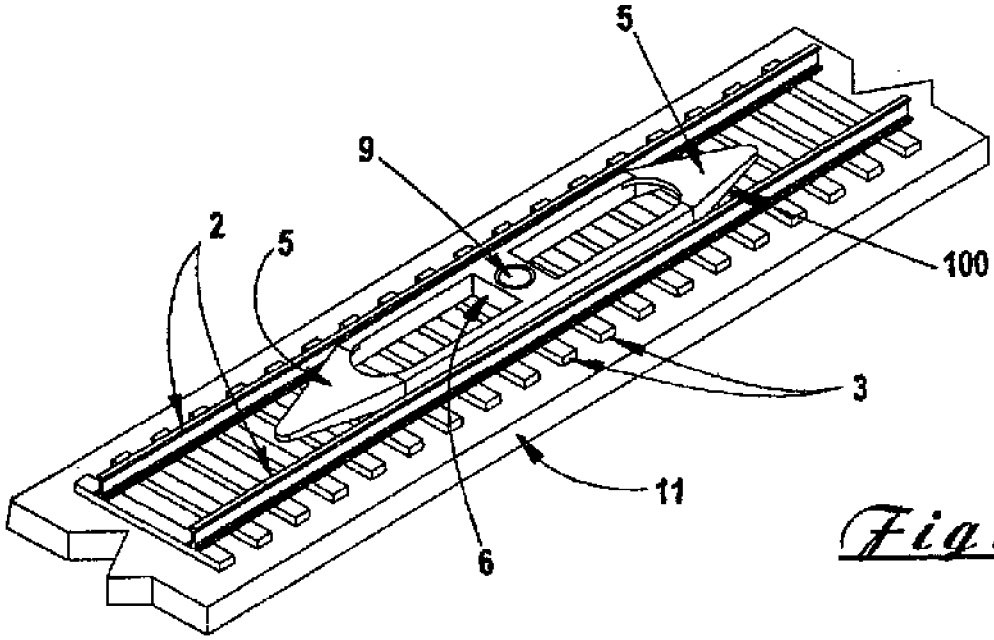
FIG. 4 is a perspective view of an exemplary rerailer as it is installed within a track gauge.

FIG. 4 is a perspective view of an exemplary rerailer rerailer as it is installed within a track gauge. To discuss the functional aspects of rerailer 100, FIG. 4 provides a view of the invention as it may be deployed in accordance with one preferred embodiment. As discussed in reference to FIG. 1, each end section 5 may represent a leading inclined section. Therefore, for the sake of explanation, it should be understood that the end section 5 that is first engaged by a moving railcar will herein be referred to as the leading end section.

When a railcar becomes derailed, one or more railcar wheels, affixed to a shared axle, disengage the track 2. Most frequently, when this occurs, one wheel descends within the track gage while an opposite wheel descends outside of the track gauge. Therefore, in order to position the wheels back onto the tracks, the wheels need to be aligned both vertically and horizontally with the tracks. As a railcar, in motion and having one or more derailed wheels, engages a leading end section 5 of rerailer 100, a wheel that has descended within the track gauge contacts the side portion of leading end section 5. As the railcar continues its movement, the distal taper of leading end section 5 progressively aligns the wheel into horizontal alignment with the track 2. At the same time, the incline of the leading end section 5 raises a wheel from the track bed to a height sufficient for the wheel flange, of a wheel outside of the track gauge, to clear the top surface of the track 2. As the railcar moves over the center section of rerailer 100, both wheels of a shared axle become horizontally aligned with the tracks 2.

Figure 5:
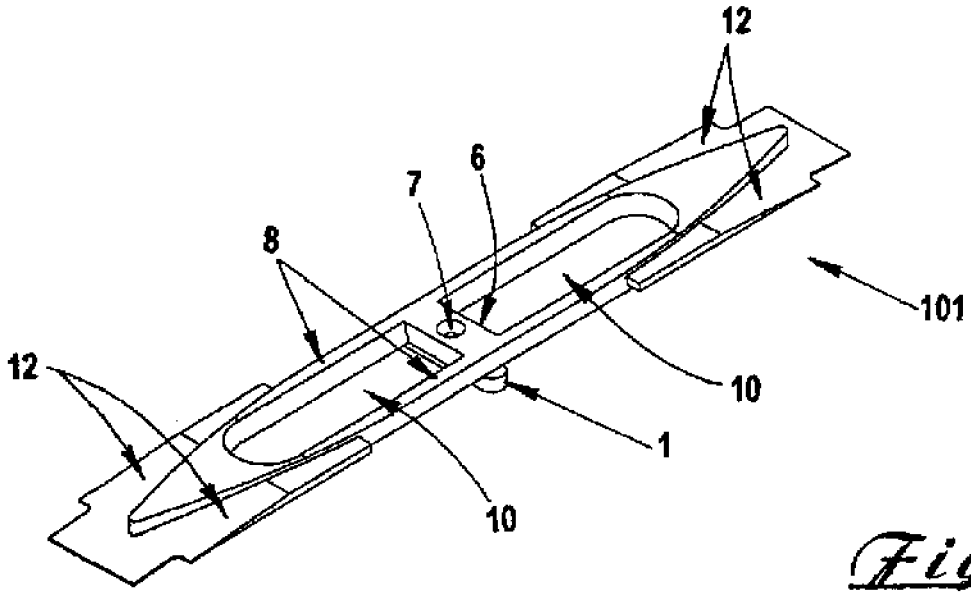
FIG. 5 is a top perspective view of an alternative embodiment of an exemplary rerailer.

FIG. 5 is a top perspective view of an alternative embodiment of an exemplary rerailer. In this alternative embodiment, end sections each further comprise a ramp-up feature 12. This embodiment includes many of the features of the preferred embodiment, such as having an opening 10 to allow for greater flexibility, a center strut 6 to help ensure that the side portions 8 remain aligned with the tracks, a cleat 1 to be received between two rail ties, and a vertical bore 7 to receive a fastener.

However, the most apparent differences are in the configuration of the end sections where the distally tapered feature of rerailer 101 further includes a leading end inclined ramp-up 12. As previously discussed, depending on the direction of movement of a railcar, either end of section 12 may represent a leading end inclined ramp-up.

Further, according to this embodiment, spacers may not be necessary to ensure that rerailer 101 remains secured in an optimal position within a track gauge. Rather, the ramp-up 12 may serve this purpose wherein the side portions of the each may engage the inner portions of each track, thus ensuring optimal positioning of rerailer 101 within the track gauge.

Figure 6:
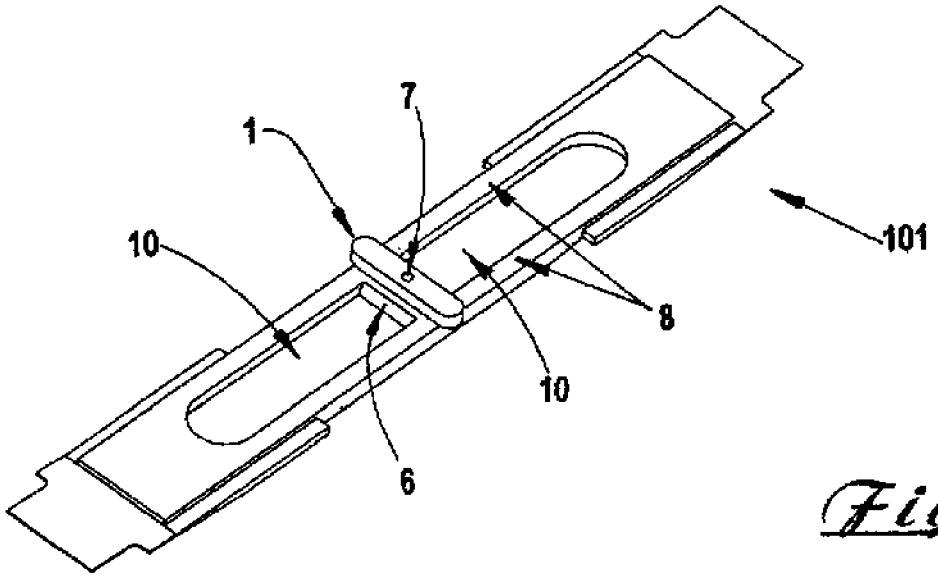
FIG. 6 is a bottom perspective view showing further details of an exemplary rerailer of FIG. 5.

FIG. 6 is a bottom perspective view of an alternative embodiment of the exemplary rerailer of FIG. 5 showing features described in reference to the preferred embodiment of FIG. 2.

Figure 7:
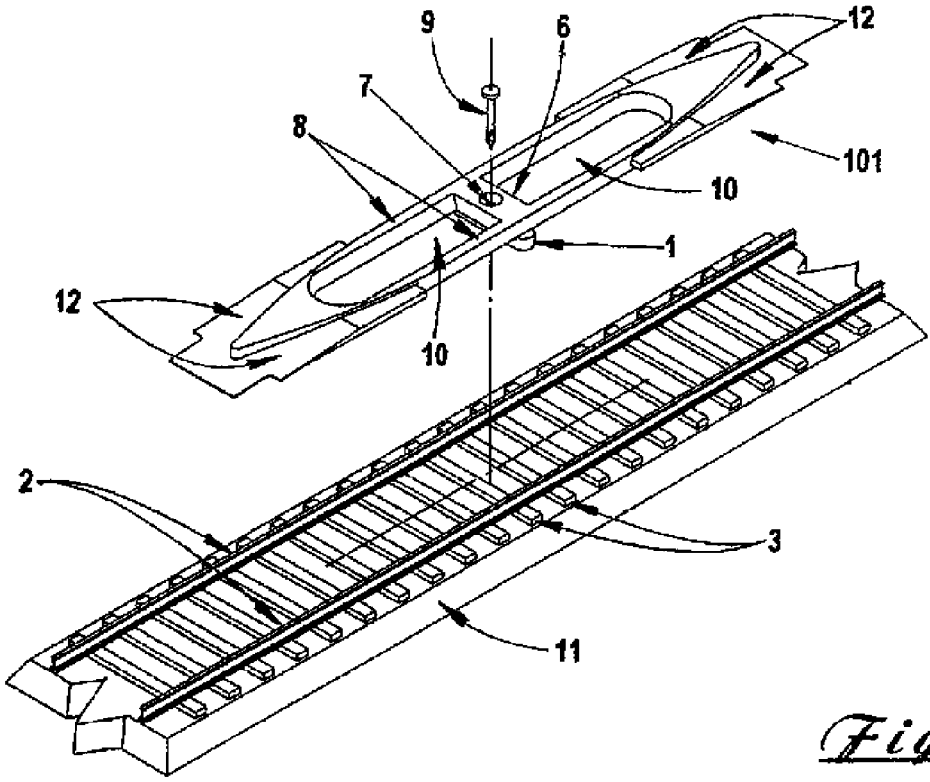
FIG. 7 is an exploded perspective view of an alternative embodiment of an exemplary rerailer of FIG. 5 further illustrating the placement of the rerailer relative to a track section prior to installation.

FIG. 7 is an exploded perspective view of an alternative embodiment of an exemplary rerailer of FIG. 5 further illustrating the placement of the invention relative to a track section prior to installation. As previously described, the ramp-up 12 features of this embodiment may eliminate the need for the spacers as included in the preferred embodiment. As rerailer 101 is installed within the track gauge, the side portions of the ramp-up, 12 features may engage the inner portions of the tracks 2 ensuring a secure fit with optimal spacing within the track gauge.

Figure 8:
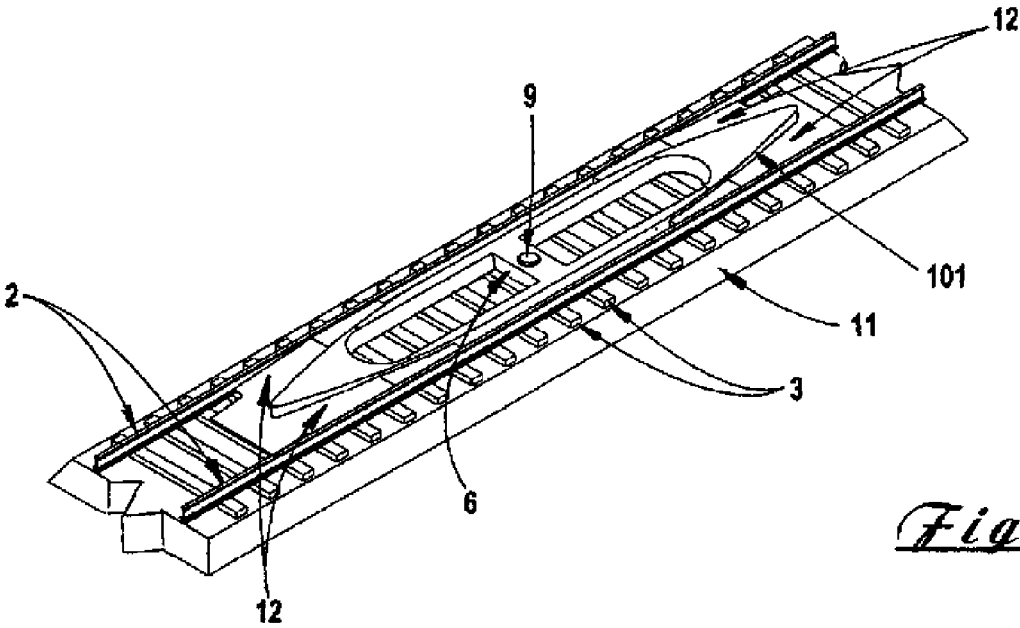
FIG. 8 is a perspective view of an alternative embodiment of an exemplary rerailer of FIG. 5 as it is installed within a track gauge.

FIG. 8 is a perspective view of an alternative embodiment of an exemplary rerailer as it is installed within a track gauge. FIG. 8 provides a view of rerailer 101 as it may be implemented in order to describe the functional aspects of the embodiment. As discussed in reference to FIG. 5, depending on the railcar direction of movement, either end section 12 may represent a leading end ramp-up. Therefore, for the sake of explanation, it should be understood that the end section 12 that is first engaged by a moving car will be referred to as the leading end ramp-up.

In order to reposition a derailed railcar wheel onto a track 2, the wheel needs to be aligned both vertically and horizontally with the track 2. As a forward moving railcar, having one or more derailed wheels, engages a leading end ramp-up 12 of rerailer 101, a wheel that has descended within the track gauge engages the base of the leading end ramp-up. As the railcar continues to move forward, the distal taper progressively aligns the wheel into horizontal alignment with the tracks 2. At the same time, the wheel engaging the incline of the leading end ramp-up 12, progresses up the incline to height sufficient for the wheel flange of a wheel outside of the track gauge to clear the top surface of the track 2. As the railcar moves over the center section of rerailer 101, wheels along a shared axle are aligned horizontally with the tracks 2.

The foregoing description of the exemplary embodiments of the invention have been presented for the purposes of illustration and description. It is not intended to be exhaustive or to limit the invention to the precise form disclosed. Many modifications and variations are possible in light of the above teaching. It is intended that the scope of the invention be limited not with this detailed description, but rather by the claims appended hereto.

What is claimed is:

1. A device for rerailing a wheel of a railcar comprising:

a center section configured for longitudinal alignment within a track gauge, said center section having a top surface;

a leading end comprising an incline toward said top surface of said center section, and further comprising a distally tapered feature;

a trailing end comprising a decline away from said top surface of said center section, and further comprising a distally tapered feature;

an insert alignment feature; and a track section engaging feature comprising at least one cleat downwardly depending from said center section, said cleat being suitably dimensioned to be securely received between two rail ties.

2. The device of claim 1 wherein said device is molded of a flexible material.

3. The device of claim 2 wherein said flexible material is plastic.

4. The device of claim 2 wherein said flexible material is polypropylene.

5. The device of claim 1 wherein said insert alignment feature comprises at least one spacer extending outwardly from a side portion of the device to engage an inner portion track rail.

6. The track section engaging feature of claim 1 further comprising a bore extending vertically through said cleat and said center section.

7. The bore of claim 6 further characterized by a countersink of said bore positioned on said top surface of said center section.

* * * * *